US008096897B2

(12) United States Patent
Beach et al.

(10) Patent No.: US 8,096,897 B2
(45) Date of Patent: Jan. 17, 2012

(54) GOLF CLUB-HEADS HAVING A PARTICULAR RELATIONSHIP OF FACE AREA TO FACE MASS

(75) Inventors: Todd P. Beach, San Diego, CA (US); Bing-Ling Chao, San Diego, CA (US); Peter L. Larsen, San Marcos, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 425 days.

(21) Appl. No.: 11/642,310

(22) Filed: Dec. 19, 2006

(65) Prior Publication Data

US 2008/0146374 A1 Jun. 19, 2008

(51) Int. Cl.
*A63B 53/00* (2006.01)

(52) U.S. Cl. ..... 473/345; 473/349

(58) Field of Classification Search ..... 473/349, 473/345–346

See application file for complete search history.

(56) References Cited

U.S. PATENT DOCUMENTS

| | | | | |
|---|---|---|---|---|
| 6,824,475 | B2 * | 11/2004 | Burnett et al. | 473/329 |
| 6,991,558 | B2 | 1/2006 | Beach et al. | |
| 7,066,832 | B2 * | 6/2006 | Willett et al. | 473/329 |
| 7,108,612 | B2 * | 9/2006 | Nakahara et al. | 473/329 |
| 7,163,470 | B2 * | 1/2007 | Galloway et al. | 473/342 |
| 2004/0097299 | A1 * | 5/2004 | Soracco | 473/342 |
| 2004/0185962 | A1 * | 9/2004 | Yabu | 473/345 |
| 2004/0235584 | A1 * | 11/2004 | Chao et al. | 473/342 |
| 2005/0101407 | A1 * | 5/2005 | Hirano | 473/342 |
| 2005/0239575 | A1 | 10/2005 | Chao et al. | |
| 2006/0189407 | A1 * | 8/2006 | Soracco | 473/329 |
| 2007/0099727 | A1 * | 5/2007 | Sugimoto | 473/345 |

OTHER PUBLICATIONS

Jun. 15, 2010, Excel Spreadsheet, "Exhibit 1—Comparison of Chao et al. vs. Present Invention".*

* cited by examiner

*Primary Examiner* — Gene Kim
*Assistant Examiner* — Matthew B Stanczak
(74) *Attorney, Agent, or Firm* — Klarquist Sparkman, LLP

(57) ABSTRACT

Golf clubs and club-heads for same are disclosed. An exemplary club-head has a hollow body and a face plate. The body defines a front opening and a face support, wherein the face plate is affixed to the face support and covers the front opening. The "face portion" of the club-head has a face area ($A_f$, in $mm^2$) and a face mass ($M_f$, in grams), wherein $A_f \geqq 5400\ mm^2$, and in a plot of $M_f$ as a function of $A_f$, $M_f$ is below $M_f = 0.0072(A_f)+18$. At least a portion of the face plate can be made of composite. E.g., the face plate can include a composite plate made of carbon fiber and cured epoxy resin. The strike face of the face plate can include a composite plate and a cap bonded to the composite plate on the strike face. The cap can be made of a metallic material, such as (but not limited to) titanium alloy or stainless steel.

31 Claims, 12 Drawing Sheets

GOLF CLUB-HEADS HAVING A PARTICULAR RELATIONSHIP OF FACE AREA TO FACE MASS

FIELD

This disclosure pertains generally to golf clubs and club-heads. More particularly the disclosure pertains to, inter alia, wood-type club-heads and other types of club-heads that have a face insert.

BACKGROUND

With the ever-increasing popularity and competitiveness of golf, substantial effort and resources are currently being expended to improve golf clubs so that increasingly more golfers can have more enjoyment and more success at playing golf. Much of this improvement activity has been in the realms of sophisticated materials and club-head engineering. For example, modern "wood-type" golf clubs (notably, "drivers" and "utility clubs"), with their sophisticated shafts and non-wooden club-heads, bear little resemblance to the "wood" drivers, low-loft long-irons, and higher numbered fairway woods used years ago. These modern wood-type clubs are generally called "metal-woods."

An exemplary metal-wood golf club such as a fairway wood or driver typically includes a hollow shaft having a lower end to which a hollow club-head is attached. Most of these club-heads are made, at least in part, of a light-weight but strong metal such as titanium alloy. The club-head comprises a body to which a strike plate (also called a face plate) is attached or integrally formed. The body includes a hosel that extends generally upward and is connected to the shaft of the club. The body also includes a heel region situated close to the hosel, a toe region situated opposite the heel region, a sole (lower) region, and a crown (upper) region. The body bears most of the impact load imparted to the strike plate when the club-head strikes a golf ball. The strike plate defines a front surface or strike face that actually contacts the golf ball.

In contrast to wood-type clubs used years ago, the club-heads of many modern metal-woods are hollow, which has been made possible by the use of light-weight, strong metals and other materials for fabricating the club-head. Use of titanium and other light-weight metal alloys has permitted the walls of the club-head to be made very thin, which has permitted the club-heads to be made substantially-larger than their predecessors. These larger club-heads tend to provide a larger "sweet spot" on the strike plate and to have higher club-head inertia, thereby making the club-heads more "forgiving" than smaller club-heads. This "forgiveness" means that a golfer using the club who strikes the ball from a face location other than the sweet spot still produces a ball trajectory that is substantially similar to the shot that he otherwise would have made if he had struck the ball on the sweet spot. Characteristics such as size of the sweet spot are determined by many variables including the shape profile, size, and thickness of the strike plate as well as the location of the center of gravity (CG) and the moment of inertia (MOI) of the club-head.

There are practical limits to the maximum size of club-heads, based on factors such as the particular material of the club-head, the mass of the club-head, and the strength of the club-head. Generally, as club-head sizes increase, body walls and face plates are correspondingly thinner. The distribution of mass around the club-head typically is quantified by parameters such as rotational moment of inertia (MOI) and CG. Club-heads typically have multiple MOIs, each associated with a respective Cartesian reference axis (x, y, z) of the club-head. A rotational MOI is a measure of the club-head's resistance to angular acceleration (twisting or rotation) about the respective reference axis. The MOIs are related to, inter alia, the distribution of mass in the club-head with respect to the respective reference axes. Each of the MOIs desirably is maximized as much as practicable to provide the club-head with more forgiveness.

To achieve the high MOIs, the mass of the club-head typically is distributed, as much as possible, strategically around the periphery of the club-head and rearward of the face plate. As a result, the club-head's CG generally is located rearwardly from the face plate at a prescribed location, which helps the club produce a desired launch angle upon impact with a golf ball.

Another factor in modern club-head design is the face plate. Impact of the face plate with the golf ball causes some rearward deflection of the face plate. This deflection and the subsequent recoil of the face plate are expressed as the club-head's coefficient of restitution (COR). A thinner face plate generally deflects more at impact than a thicker face plate of the same material, thus providing the thinner face plate with more recoil than a thicker face plate. Consequently, a club-head having a thinner face plate potentially can impart more energy and thus a higher initial velocity (rebound velocity) to a struck golf ball than a club with a thicker, more rigid face plate. This rebound phenomenon is called the "trampoline effect" and is an important determinant of the flight distance of the struck ball. Since face-plate deflection is usually greater in the sweet spot, a ball struck by the sweet spot generally will have a greater rebound velocity than a ball struck off-center, and thus generally will travel farther. Because of the importance of the trampoline effect, the COR of clubs is limited under USGA rules.

To achieve these ends, it typically is desirable to incorporate thin walls, including the face plate, into the designed configuration of the club-head. Thin walls also allow additional leeway in distributing club-head mass strategically to achieve a desired mass distribution and a desired high COR.

The volume of club-heads of metal-woods is limited by USGA rules. Nevertheless, certain of these club-heads have become rather large, the largest having a volume of about 460 $cm^3$. These large club-heads have a correspondingly large strike face that presents a tall face height to the ball. Consequently, with many golfers using these clubs, there is an increased probability that the ball will be struck by the strike plate at a location other than the sweet spot. With a large strike face, these off-center shots still provide good ball-launch velocity. However, currently available large-area face plates add significant mass to the front of the club-head, which reduces the amount of mass available for placement elsewhere in the club-head, and undesirably shift the CG forwardly.

Regarding the total mass of the club-head as the club-head's mass budget, it is axiomatic that at least some of the mass be dedicated to achieving the required strength and structural support of the club-head. This is termed "structural" mass. Any mass remaining in the budget is called "discretionary" or "performance" mass, which can be distributed within the club-head to maximize performance. Much of the current research and development activity concerning golf clubs is directed to various ways of distributing the discretionary mass. For example, some club-heads include one or more weights placed relative to the heel-toe (x) axis and in-line with the percussion axis of the club-head.

As club-head engineering converges on certain basic arrangements of discretionary mass in a club-head, particularly in metal-woods, obtaining a maximal amount of any remaining discretionary mass is becoming increasingly important, especially with larger club-heads. Conventional ways of removing mass from the face plate are not always successful; if too much mass is removed from the face plate, the structural mass of the strike plate may be excessively compromised, which can result in the strike plate being too fragile and/or its COR being too high.

Another conventional approach involves using alternative materials for fabricating the club-head. Whereas the bodies and face plates of most metal-woods currently on the market are made of titanium alloy, several "hybrid" club-heads are available that are made, at least in part, of graphite-composite or another composite material. In one group of these club-heads the body is made of composite, but titanium alloy or steel is used as the primary face-plate material.

Other hybrid club-heads are made entirely of composite material (notably graphite composite). But, for several reasons, these club-heads tend to be limited to smaller face areas. First, with a conventional face plate made of composite, it has heretofore been difficult to provide the face plate with sufficient structural strength while still conforming to USGA and R&A rules for the "spring-like effect" (COR≦0.830, CT≦257 μsec). ("CT" is the "characteristic time" standard.) Second, whereas smaller club-heads made of composite can be mass-efficient, potentially even more so than similarly sized all-metal club-heads, scaling up the composite technology to produce desired larger face areas results in less mass-efficiency. One cause of this decreased mass efficiency is the required large thickness of the "sole lip" and "crown lip" at which the face plate transitions to the body. Joining a composite face plate to a composite body by current technology requires not only careful overlap of face plies with body plies in the transition zones, but also substantially thicker transition zones, which tend to negate the potential mass savings of replacing titanium alloy (density=4.5 g/cm$^3$) with composite (density=1.5 g/cm$^3$ for graphite composite). Thus, this technique is simply not mass-efficient (and may actually pose a mass-penalty) for club-head configurations having large face areas. There is also a general consensus that all-composite club-heads produce a disagreeable impact sound during play, mainly due to the overall stiffness of the composite structure and the damped nature of composite material compared to metal.

In view of the above, a need exists for improved metal-wood golf clubs and club-heads that have low-mass face plates, especially large-area face plates, that have sufficient mechanical strength for their intended use, and that conform to USGA and R&A restrictions on the "Spring-Like Effect."

SUMMARY

The need articulated above is met by various aspects of the instant invention, of which a first aspect pertains to club-heads for golf clubs. An embodiment of such a club-head comprises a hollow body and a face plate. The body defines a front opening having a face support, and the face plate is affixed to the face support and covers the front opening. The "face portion" (as defined herein) of the club-head has a face area ($A_f$) and a face mass ($M_f$, in grams), wherein $A_f \geqq 5400$ mm$^2$. In a plot of $M_f$ as a function of $A_f$, $M_f$ is below $M_f=0.0072(A_f)+18$.

In certain embodiments at least a portion of the face plate comprises a composite material. For example, the face plate can comprise a composite plate. The composite plate can comprise carbon fiber and cured epoxy resin. In other embodiments the face plate has a strike face, wherein the face plate comprises a composite plate and a cap bonded to the composite plate on the strike face. The cap can comprise a metallic material, such as (but not limited to) titanium alloy or stainless steel.

In certain embodiments the face plate has a substantially uniform thickness. In other embodiments the face plate has a variable thickness. For example, the peripheral regions of the face plate can be thinner than the central region of the face plate.

In other embodiments the face plate comprises a composite plate and a metal cap bonded to the composite plate on the strike face. The composite plate can have a substantially uniform thickness, with the metal cap having a substantially uniform thickness. Alternatively, the composite plate can have a variable thickness, with the metal cap having a substantially uniform thickness.

The body typically comprises body walls collectively having an external contour for the particular club-head. The body walls have a transition zone in which the body contour transitions to the face plate. Desirably, the transition zone has an inside radius in a range of 0.1 to 3.0 mm. This range is suitable for bodies comprising any of various light-weight materials, such as titanium alloy.

The face area $A_f$ desirably is within the range of 5400 to 10,000 mm$^2$. More desirably, $A_f$ is within the range of 7000 to 10,000 mm$^2$. Even more desirably, $A_f$ is within the range of 8500 to 10,000 mm$^2$.

According to another aspect, golf clubs are provided. An embodiment of such a golf club comprises a club-head, comprising a hollow body and a face plate. The body defines a front opening having a face support, and the face plate is affixed to the face support and covers the front opening. A shaft is affixed to the club-head. With respect to the face portion of the club-head, $A_f \geqq 5400$ mm$^2$, and in a plot of $M_f$ (in grams) as a function of $A_f$, $M_f$ is below $M_f=0.0072(A_f)+18$. The golf club can be configured to include a hosel to which the shaft is affixed. By way of example, the golf club is configured as a driver or other metal-wood.

The face plate of the golf club can have any of the configurations summarized above with respect to a club-head. For example, the face plate can comprise a composite plate made of carbon fiber and cured epoxy resin. A cap can be bonded to the composite plate on the strike face. The cap can comprise a metallic material such as, but not limited to, titanium alloy. Also, the body can be made, at least in part, of titanium alloy and/or can have a transition zone as summarized above. The face plate can have a substantially uniform or a variable thickness.

The foregoing and additional features and advantages of the invention will be more readily apparent from the following detailed description, which proceeds with reference to the accompanying drawings.

DETAILED DESCRIPTION

This disclosure is set forth in the context of representative embodiments that are not intended to be limiting in any way.

In the following description, certain terms may be used such as "up," "down," "upper," "lower," "horizontal," "vertical," "left," "right," and the like. These terms are used, where applicable, to provide some clarity of description when dealing with relative relationships. But, these terms are not intended to imply absolute relationships, positions, and/or orientations. For example, with respect to an object, an "upper" surface can become a "lower" surface simply by turning the object over. Nevertheless, it is still the same object.

Figure 1:
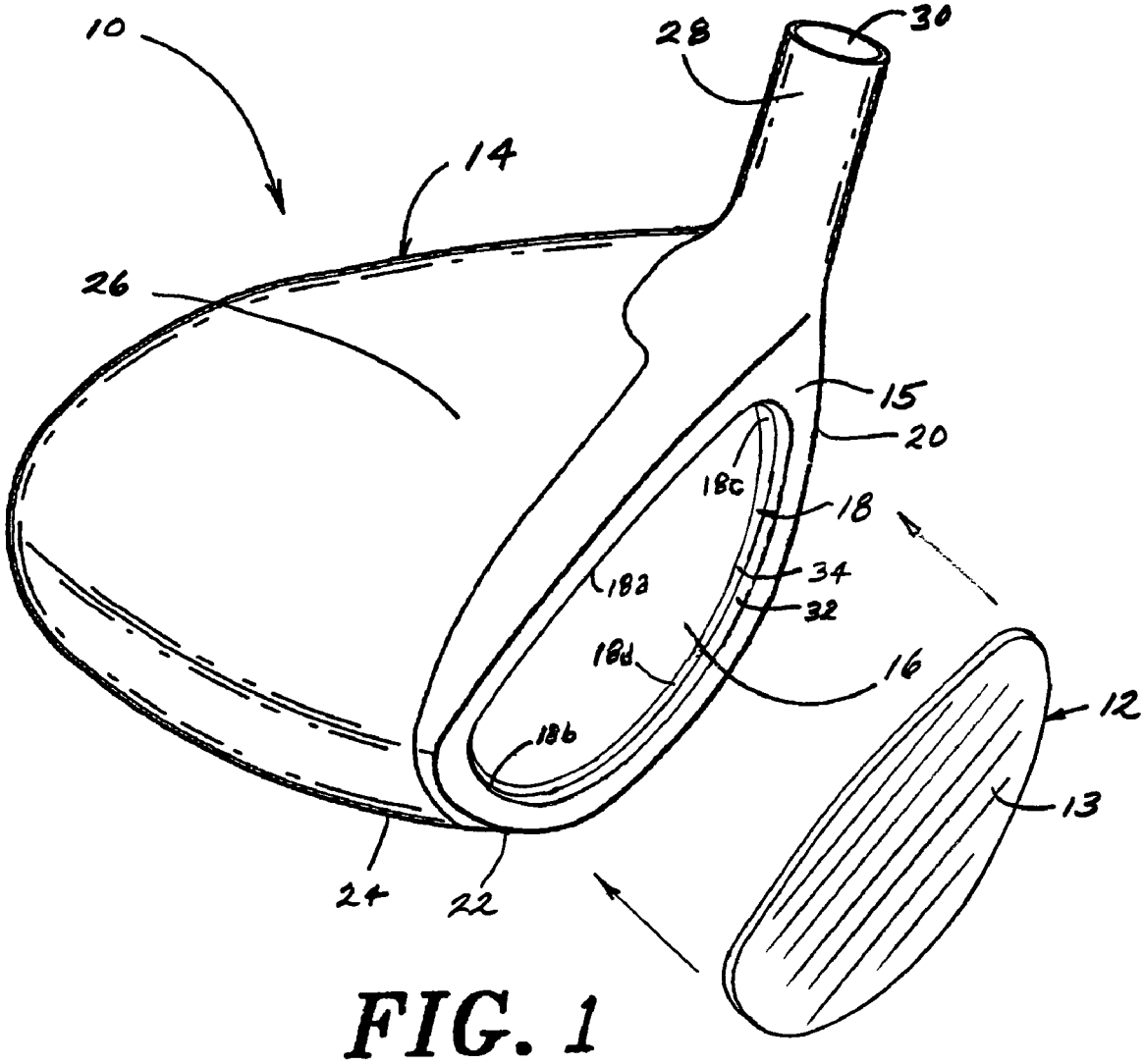
FIG. 1 is a perspective view of a "metal-wood" club-head, showing certain general features pertinent to the instant disclosure.

The main features of an exemplary metal-wood club-head 10 are depicted in FIG. 1. The club-head 10 comprises a face plate 12 and a hollow body 14. The face plate 12 typically is convex, and has an external ("striking") surface (face) 13. The body 14 has walls and defines a front opening 16. A face support 18 is disposed about the front opening 16. The body 14 also has a heel 20, a toe 22, a sole 24, a top or crown 26, and a hosel 28. Around the front opening 16 is a "transition zone" 15 that extends along the respective forward edges of the heel 20, the toe 22, the sole 24, and the crown 26. The transition zone 15 effectively is a transition from the walls of the body 14 to the face plate 12. The opening 16 receives the face plate 12, which rests upon and is bonded to the face support 18 and transition zone 15, thereby enclosing the front opening 16. The transition zone 15 includes a sole-lip region 18*d*, a crown-lip region 18*a*, a heel-lip region 18*c*, and a toe-lip region 18*b*. The hosel 28 defines an opening 30 that receives a distal end of a shaft (not shown).

Figure 2A:
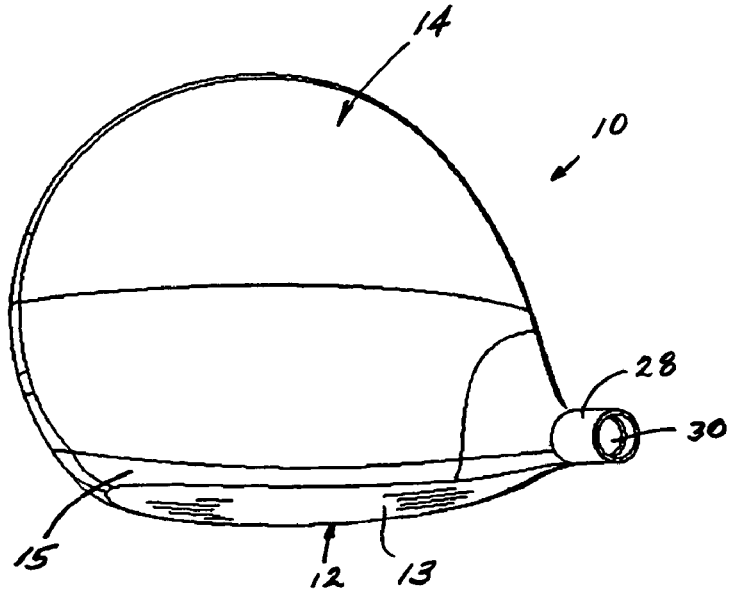
FIGS. 2(A)-2(C) are respective orthogonal views depicting a metal-wood club-head having a strike face and depicting a manner in which the strike face transitions into the contour of the body of the club-head.
Figure 2C:
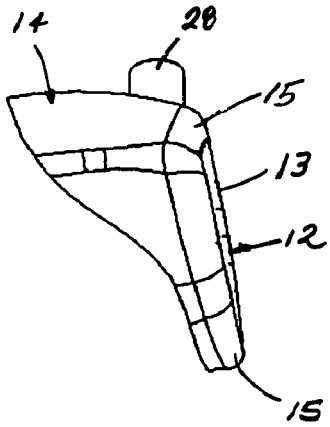
Figure 2B:
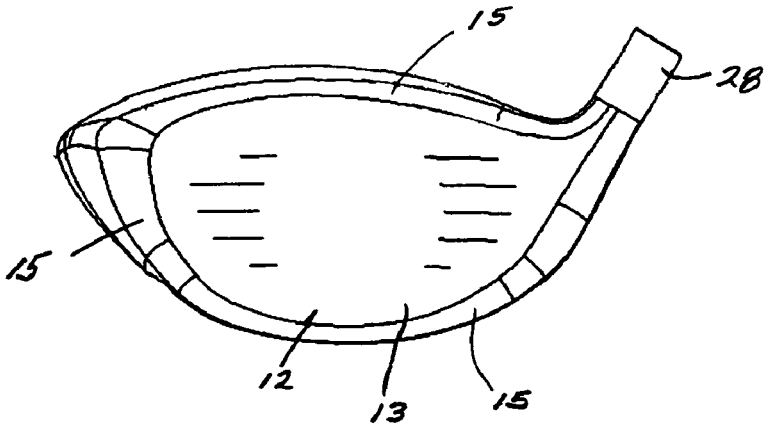

The subject club-heads satisfy a particular relationship of face mass as a function of face area. More specifically, for face areas ($A_f$) of 5400 $mm^2$ and greater, the range of face mass resides below the linear plot $M_f$=0.0072($A_f$)+18, wherein $M_f$ is the face mass (g), and $A_f$ is the face area ($mm^2$). A key variable in this relationship is the face area $A_f$, which is defined and determined as follows:

As discussed above, all club-heads have a face (strike surface) 13 that is intended to hit the golf ball. In the transition zone 15 of a metal-wood 10 the face 13 transitions to the external contour of the body 14, as shown in FIGS. 2(A)-2(C). The shapes of the face 13 and the transition zone 15 can vary substantially from club-head to club-head and from manufacturer to manufacturer. In view of these differences, it is important to have a standard definition of and method for measuring face area $A_f$. Part of the task of defining face area $A_f$ is dealing with the hosel 28. The hosel 28 is generally not intended as a ball-impact location and thus should not be included in the determination of face area $A_f$ or face mass $M_f$. Since the hosel 28 serves only to connect the club-head to the shaft of the golf club, and since a few club-heads currently available have so-called "internal hosel" configurations, the manner of determining face area $A_f$ (as well as face mass $M_f$) should exclude any contributions by the hosel, regardless of the club-head configuration.

Figure 3:
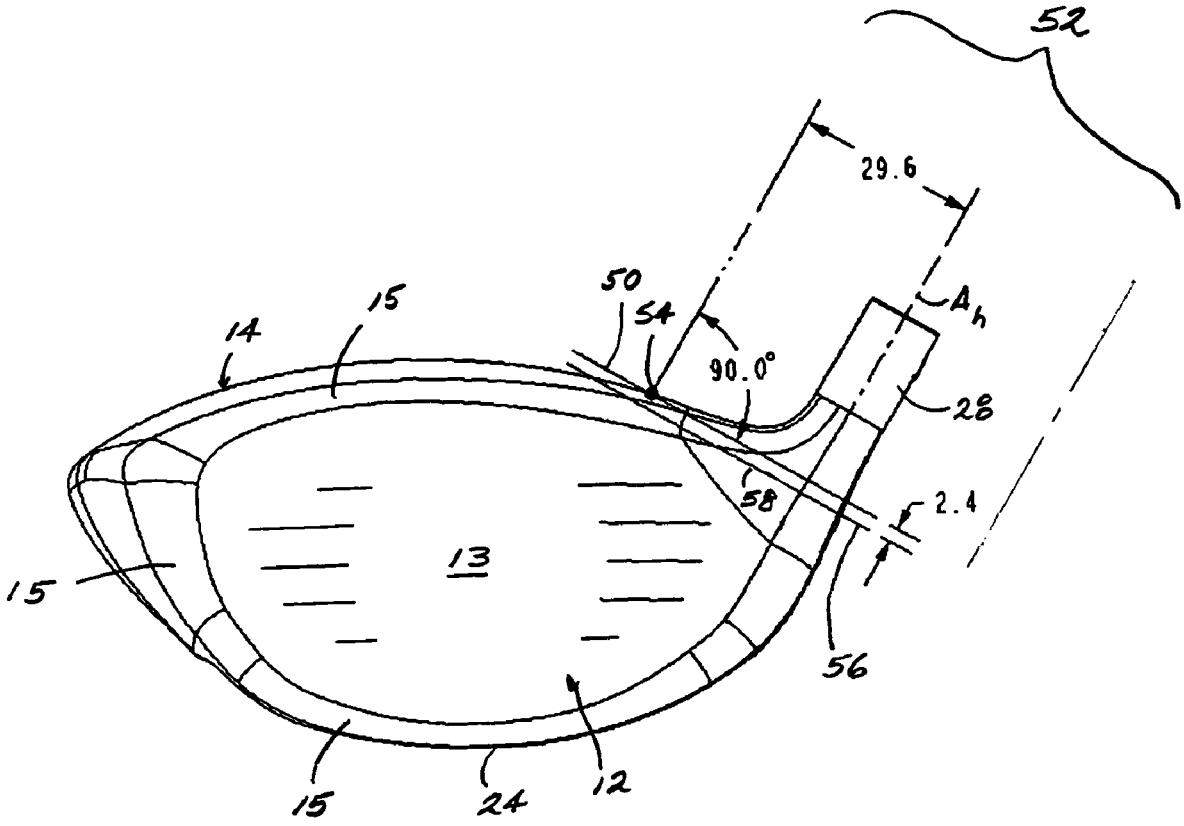
FIG. 3 is a front elevational view of a metal-wood club-head, depicting the manner of defining a first cut plane in the method for obtaining a face portion of the club-head for obtaining a standard measurement, as disclosed herein, of face area and face mass.

The desired manner of determining face area $A_f$ is as follows, described with reference to a conventional club-head for a metal-wood as shown in FIG. 3. The club-head includes a body 14, a sole 24, a face 13 and a hosel 28. The hosel 28 extends along a hosel axis $A_h$. A "hosel-normal" plane 50 is defined that is normal to the hosel axis $A_h$. The hosel axis $A_h$ also is the axis of rotation of a cylinder 52 having a radius of 29.6 mm. The hosel-normal plane 50 is located on the hosel axis $A_h$ such that the cylinder 52 intersects the hosel-normal plane 50 and touches the surface of the body 14 at the point 54. A first cut plane 56 is defined as being parallel to the hosel-normal plane 50 but displaced 2.4 mm toward the sole 24. The first cut plane 56 can be denoted by the line 58 that can be scribed on the face 13 and used later as a cut-line for removing the hosel 28 from the club-head.

Figure 4:
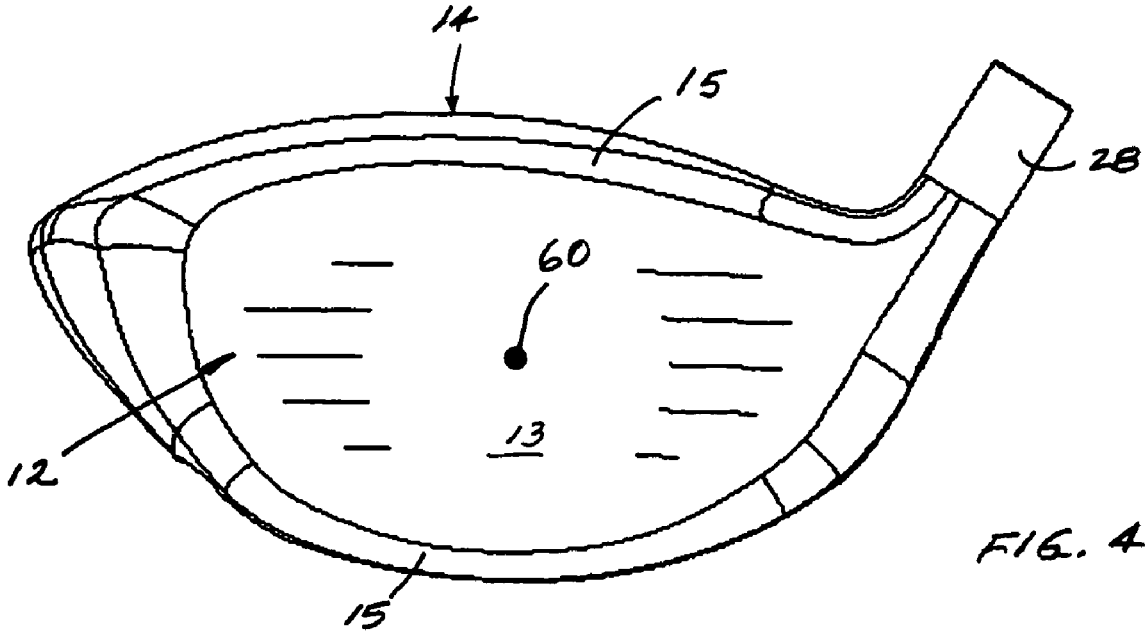
FIG. 4 is a front elevational view of the club-head of FIG. 3, depicting a face plate on which a face center has been defined as part of the method for obtaining a face portion.
Figure 5:
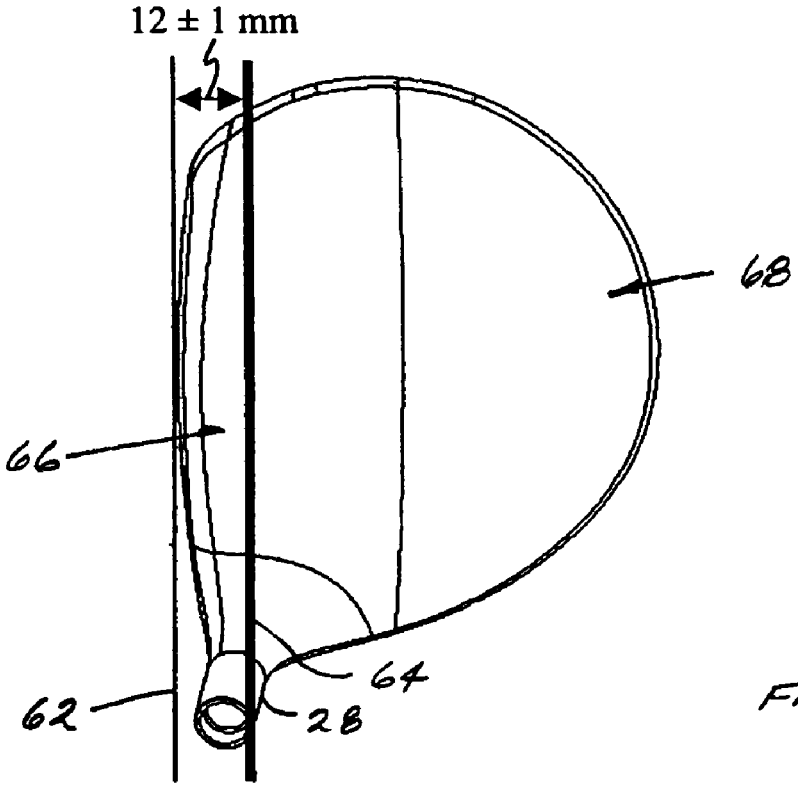
FIG. 5 is a top view of the club-head of FIG. 3, depicting the manner of defining a second cut plane in the method for obtaining a face portion.

The face center 60 of the face 13 is located using a method as described in the USGA pendulum test ("Procedure for Measuring the Flexibility of a Golf Clubhead," Rev. 2.0, Mar. 25, 2005). A typical face center 60 is shown in FIG. 4. Turning now to FIG. 5, a "tangent plane" 62 is defined as being tangent to the face 13 at the face center 60 and normal to the "loft plane" (not shown) of the club-head. A second cut plane 64 is defined as being parallel to the tangent plane 62 but located 12±1 mm rearward of the tangent plane.

Figure 6A:
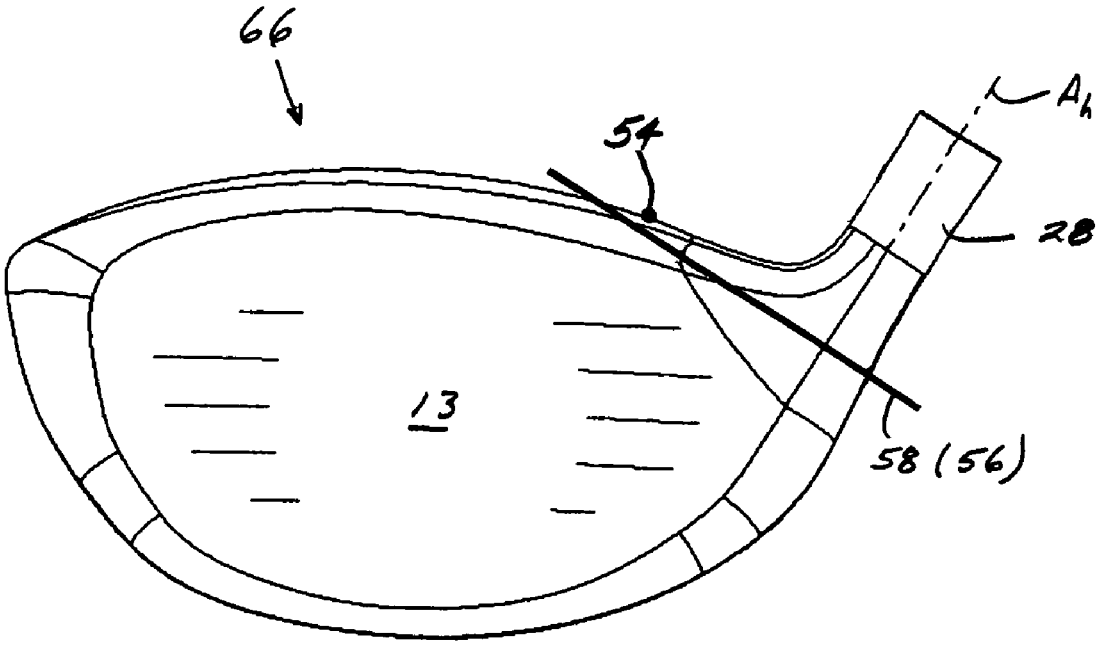
FIG. 6(A) is a front elevational view of the club-head of FIG. 3, depicting the first cut plane, used in the method for obtaining a face portion.
Figure 6B:
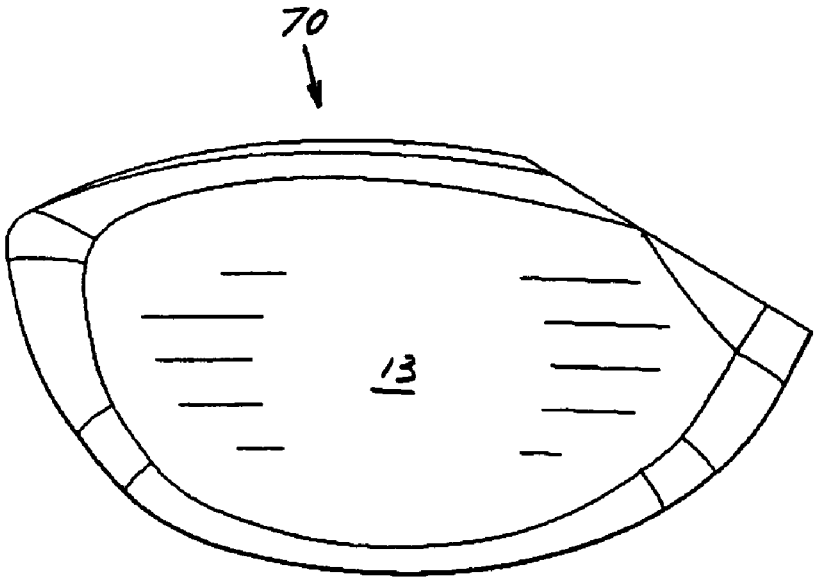
FIG. 6(B) is a front elevational view of the face portion produced according to the method.

The club-head desirably is cut first along the second cut plane 64 (FIG. 5) to remove the front portion 66 from the rear portion 68. Then, on the front portion 66 (FIG. 6(A)), a second cut is made along the first cut plane 56, using the line 58 as a guide (see FIG. 6), to remove the hosel 28. The resulting face portion 70 (FIG. 6(B)) represents a standard face-area for the club-head and is used for determining the actual face area $A_f$ of the club-head.

Figure 7:
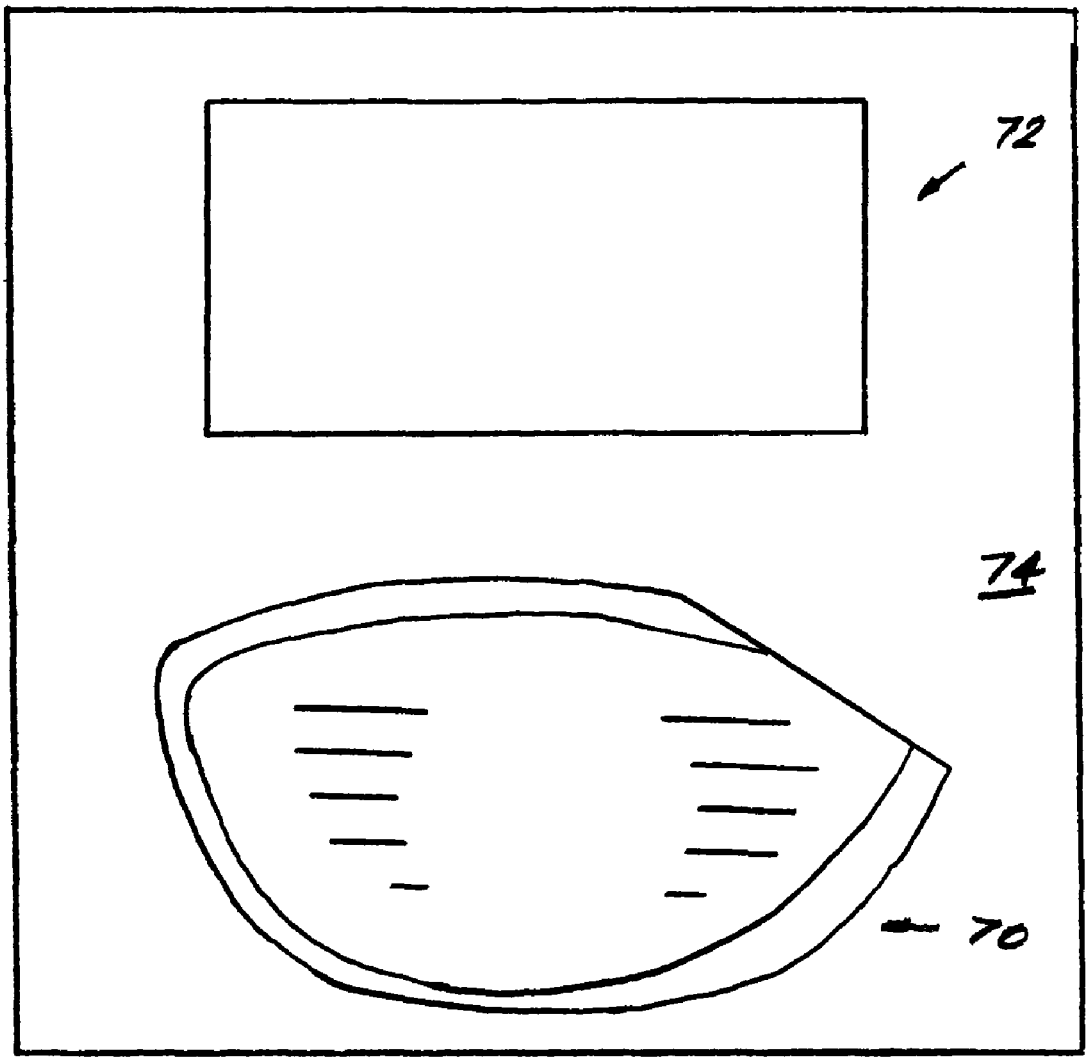
FIG. 7 is a schematic view of a reference surface (having a precisely known area) and a face portion positioned for obtaining a determination of the face area.

To determine the face area, and turning now to FIG. 7, the face portion 70 is placed adjacent a reference portion 72 (having a precisely known reference area) on a planar background 74. The face portion 70 and reference portion 72 are imaged (preferably digitally) from a position normal to the planar background 74. Photo-editing software is used to detect the edges of, and the number of pixels inside, the reference portion 72 (in one example 259,150 "black" pixels made up the reference area of 5,010 $mm^2$). Similarly, the software is used to detect the edges of, and number of pixels inside, the face portion 70 (in the example 298,890 black pixels made up the area of the face portion 70). The actual face area is calculated as follows:

$$A_f = P_f \frac{A_r}{P_r}$$

wherein $A_f$ is the face area, $P_f$ is the pixel count in the face portion 70, $A_r$ is the area of the reference portion 72, and $P_r$ is the pixel count in the reference portion 72. In the example, if $A_r$=5,110 $mm^2$, $P_f$=298,890 pixels, and $P_r$=259,150 pixels, then $A_f$=5,894 $mm^2$.

Figure 8:
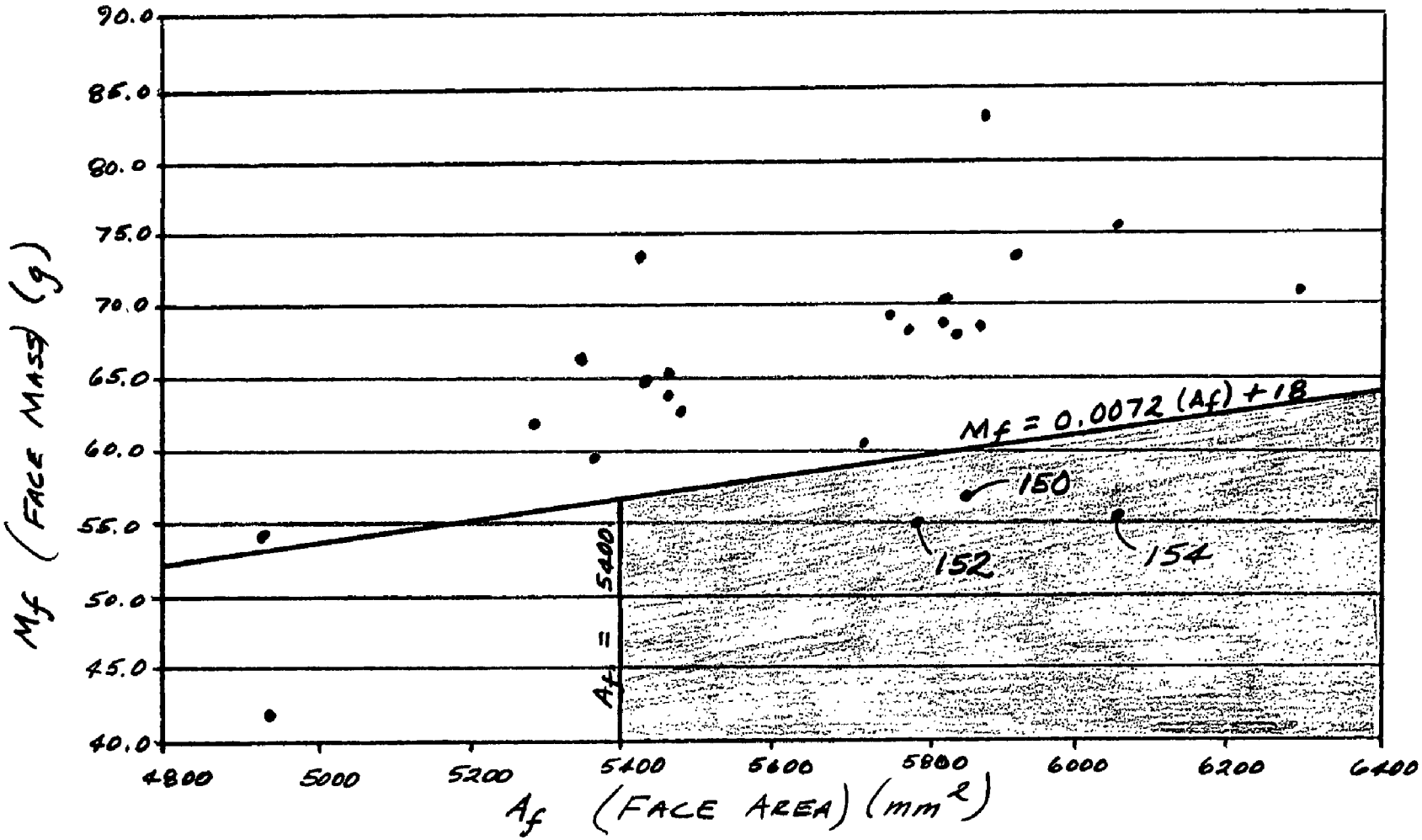
FIG. 8 is a plot of face mass versus face area, showing the sloped line $M_f$=0.0072($A_f$)+18, the vertical line $A_f$=5400, and a shaded area beneath the sloped line and to the right of the vertical line.

It will be understood that the pixel-counting technique described above is an example of a technique capable of measuring area accurately and precisely. Other are-measurement techniques can be employed in alternative methods With face areas being determined for any of various metal-wood club-heads, reference is now made to FIG. 8, which is a plot of face mass ($M_f$), in gram units, as a function of face area ($A_f$) in units of $mm^2$. Face mass $M_f$ is obtained simply by weighing the face portion 70. The depicted plot also includes the line $M_f$=0.0072($A_f$)+18 and a vertical line $A_f$=5400 $mm^2$. Also shown is a shaded region below the line $M_f$=0.0072($A_f$)+18 and to the right of the line $A_f$=5400. The various points located outside of the shaded region represent data obtained with conventional metal-wood club-heads. The points located inside the shaded area represent data exhibited by three respective examples that are discussed later below. The terms $M_f$ and $A_f$ as used in the claims have respective meanings as discussed above.

In various embodiments, the face area $A_f$ is generally greater than 5400 $mm^2$, desirably in the range of 5400 to 10,000 $mm^2$, more desirably in the range of 7000 to 10,000 $mm^2$, and most desirably in the range of 8500 to 10,000 $mm^2$.

Figure 9:
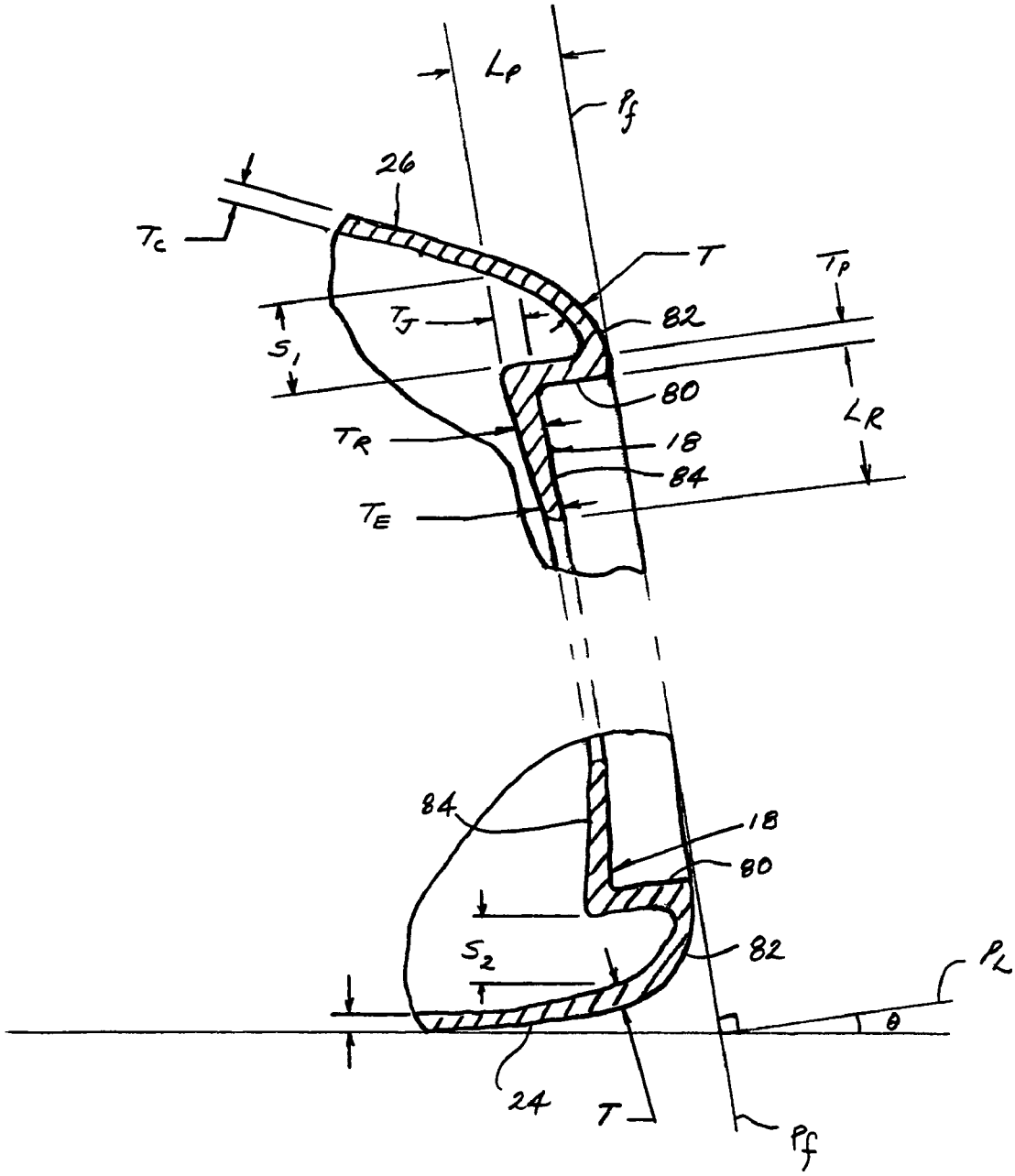
FIG. 9 is a crown-to-sole sectional view showing certain variables associated with the face support of the club-head.

Turning now to FIG. 9, the face support 18 includes a peripheral member 80 extending rearward from forward walls 82 and a rear member 84 extending inward with reference to the front opening 16. The face support includes portions proximate to the top, the toe, the heel, and the sole (see items 18*a*, 18*b*, 18*c*, 18*d* in FIG. 1). In certain embodiments, the face support is continuous about the front opening, as shown in FIG. 1. In other embodiments, one or more portions of the face support 18 are configured as multiple tabs spaced apart from each other about the front opening 16.

Referring further to FIG. 1, the face support 18 is recessed, allowing the face 13 (strike surface) of the face plate 12 to be flush with the forward wall 82 of the body. In the respective portions of the face support 18 that are proximal the crown 26 and sole 24, the peripheral member 80 is generally perpendicular to a face plane $P_f$ defined by the face plate 12, and the rear member 84 is generally parallel to the face plane. A loft plane $P_L$ of the club head is normal to the face plane $P_f$ and forms an acute angle θ with a horizontal plane.

The face support 18 is structured to provide ample surface area for receiving the face plate, thereby aiding in club durability. By way of example, the rear member 84 of the face support 18 has a thickness $T_R$ in the range of 0.5-2.5 mm and a length $L_R$ in the range of 2-25 mm. These and other parameters of the face support 18 can vary among various embodiments, based on factors such as materials used to fabricate the face plate 12, the volume of the club-head, and the dimensions of the face plate. Desirably, the thickness $T_R$ is in the range of 0.6-1.5 mm, and the length $L_R$ is in the range of 2-7 mm. The peripheral member 80 of the face support 18 has a thickness $T_P$ in the range of 0.5-2.5 mm, and a length $L_P$ in the range of 3-30 mm. Desirably, the thickness $T_P$ is in the range of 0.8-1.2 mm, and more desirably is about 1 mm. The peripheral member 80 desirably has a length $L_P$ in the range of 4-6 mm. While the peripheral member 80 most desirably has a substantially constant thickness, the rear member 84 desirably tapers inwardly toward the center of the front opening 16. With such a configuration, at the inner end of the rear member, the thickness $T_E$ is in the range of 0.6-0.9 mm.

The junction of the peripheral member 80 and rear member 84 of the face support 18 desirably has a maximum thickness $T_J$ in the range of 1.5-2 mm. The peripheral member 80 can be spaced from an inner surface of the crown by a distance $S_1$, measured in the vertical direction, of at least 1 mm. In such methods, the peripheral member 80 is spaced from the inner surface of the sole by a vertical distance $S_2$ of at least 1 mm. Desirably, the peripheral member 80 is spaced $S_1$, $S_2$ vertically at least 1.5 mm from the crown and sole.

Preferred dimensions for the body 14 of the club-head are in the range of 0.7-1 mm thickness $T_C$ for the crown 26 and in the range of 0.8-1.2 mm thickness $T_S$ for the sole 24. The wall thickness T transitioning to the forward wall 82 and the front opening 16 at the crown 26, sole 24, toe 22, and heel 20 is desirably in the range of 0.6 to 1.5 mm to provide a smoother transition to the thickness $T_P$ of the peripheral member 80 of the face support 18. The transition has a radius desirably in the range of 0.1 to 3 mm.

For mass reduction, high strength, and durability, at least a portion of the face plate 12 is a composite portion including multiple plies or layers of a fibrous material embedded in a cured resin (e.g., epoxy). An exemplary thickness range of the composite portion is 4.5 mm or less. The composite portion is configured to have a relatively consistent distribution of reinforcement fibers across a cross-section of its thickness to facilitate efficient distribution of impact forces and overall durability. The composite portion includes multiple "prepreg" plies. A prepreg ply has a respective fiber reinforcement impregnated with partially cured resin matrix. The fiber reinforcement and resin are selected to contribute to the club's durability and overall performance. Tests have demonstrated that composite portions formed of prepreg plies having a relatively low fiber areal weight (FAW) provide superior attributes in several areas, such as impact resistance, durability, and overall club performance. (FAW is the weight of the fiber portion of a given quantity of prepreg, in units of $g/m^2$.) FAW values below 200 $g/m^2$, and more desirably below 100 $g/m^2$, are effective. In this regard, a particularly suitable fibrous material for the prepreg plies is carbon fiber. More than one fibrous material can be used.

Lower FAW prepreg plies are desired for handling the large force resulting from golf-ball impact. This force is primarily transverse to the orientation of the fibers. Prepreg plies having lower FAW are thinner than those having higher FAW. Consequently, more plies can be assembled using lower FAW plies for a chosen face thickness. This provides the ability to: (1) reduce the progressive change in fiber ply, or (2) allow more frequent repetition of fiber angles through the thickness, to resist the primary failure mode (interlaminar shear) for faces made entirely or partially from composite material. Lower FAW materials accomplish these aims more effectively, especially if plies of material are included that have fibers that do not span the entire face (i.e., smaller elliptical plies located near the face center). However, since the cost of lower FAW materials is higher than of higher FAW prepreg of the same fiber and resin content, a balance desirably is achieved between durability, performance, and cost.

Figure 10:
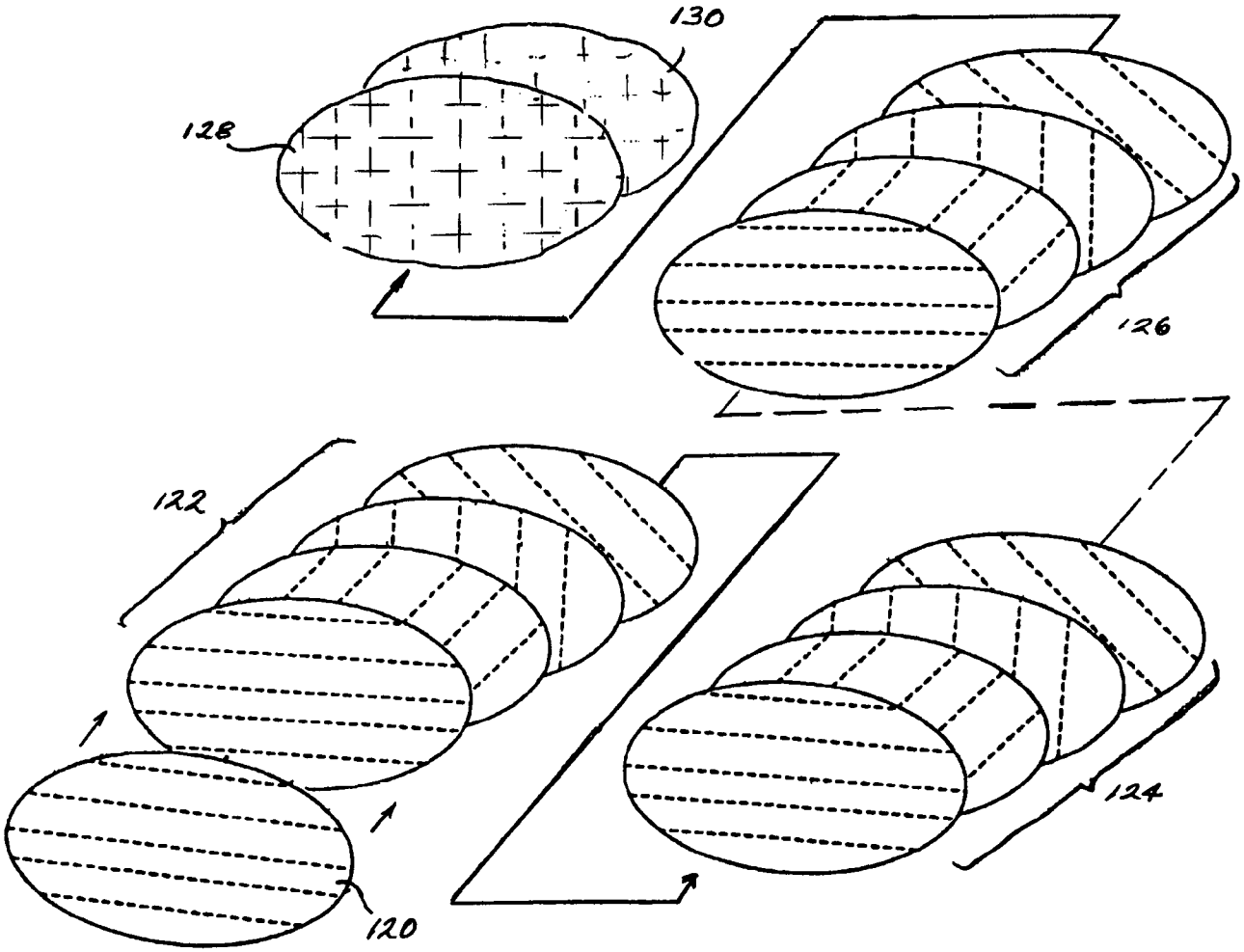
FIG. 10 is a schematic diagram showing an exemplary manner in which plies can be stacked in making a composite face plate.

The fibers of each ply have a respective orientation. More specifically, each prepreg ply has a prescribed orientation, and the plies are stacked in a prescribed order and orientation. For convenience of reference, the orientation of the plies is measured from a horizontal axis of the club-head's face plane to a line that is aligned with the fibers in the ply. Referring to FIG. 10, for example, fiber orientation is indicated by dashed lines. A first ply 120 is oriented at 90 degrees, followed by multiple unit-groups 122, 124, 126 of plies each having four plies oriented at 90, +45, 0, and −45 degrees, respectively. The resulting stack of unit-groups of plies is sandwiched between an "outer" ply 128 and an "inner" ply 130. In this embodiment, the inner and outer plies 128, 130 are formed of prepreg reinforced by glass fibers, such as 1080 glass fibers (scrim weave). The other plies are formed of unidirectional prepreg carbon fiber.

An example carbon fiber is "34-700" carbon fiber, available from Grafil, Sacramento, Calif.), having a tensile modulus of 234 Gpa (34 Msi) and a tensile strength of 4500 Mpa (650 ksi). Another Grafil carbon fiber that can be used is "Pyrofil TR50S", which has a tensile modulus of 240 Gpa (35 Msi) and a tensile strength of 4900 Mpa (710 ksi). A suitable epoxy resin is type "301" (from Newport Adhesives and Composites, Irvine, Calif.). An exemplary final resin content (R/C) is 40%.

In the general procedure described above, stacking the prepreg plies in predetermined orientations may be done by first stacking individual plies in the unit-groups 122, 124, 126, and then stacking a desired number of unit-groups (and any additional desired plies) to form the final thickness of the composite. The inner ply 128 and outer ply 130 desirably are made of a different fiber material than used in the plies of the unit-groups. The number of unit-groups can be varied as desired. One embodiment comprised sixteen unit-groups of 70 g/m$^2$ FAW material with fiber properties as stated above.

The composite face plate can be provided with its final desired shape and dimensions by die cutting. Any desired bulge and roll of the face plate may be formed during the last of two or more "debulking" or compaction steps (performed before curing, to remove and/or reduce air trapped between plies). To form the bulge or roll, the "last" debulking step can be performed against a die panel having the final desired bulge and roll. If desired, yet another (and subsequent) debulking step can be performed using the die panel to achieve the final face-plate thickness. The weight and thickness of the face plate desirably are measured before the curing step.

The potential mass "savings" obtained from fabricating at least a portion of the face plate of composite is about 10-30 g, or more, relative to a 2.7-mm thick face plate formed from a titanium alloy such as Ti-6Al-4V, for example (depending upon face area).

Figure 11:
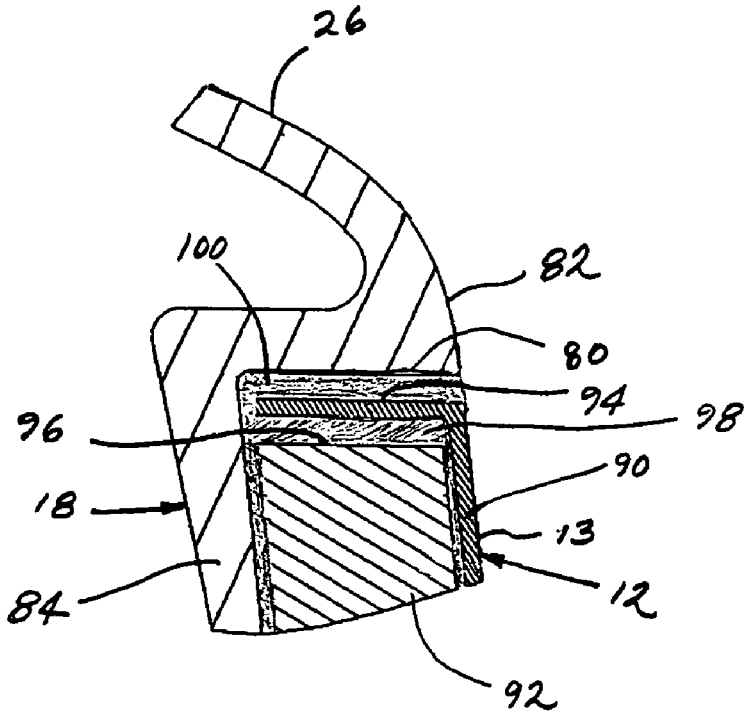
FIG. 11 is a partial sectional view showing a face plate comprising a composite plate and a metal cap, and certain relationships established when the face plate is bonded to the body of the club-head.

Attaching a composite face plate to the club-head body may be achieved using an appropriate adhesive (typically an epoxy adhesive). To prevent peel and delamination failure at the junction of an all-composite face plate with the body of the club-head, the composite face plate should be recessed from or be substantially flush with the plane of the forward surface of the metal body at the junction. Preferably, the composite face plate is sufficiently recessed so that the ends of the fibers in the plies are not exposed. In other embodiments as shown, for example, in FIG. 11, the face plate 12 comprises a metal "cap" 90 formed or placed over the composite plate 92 to form the strike surface 13. A particularly desirable metal for the cap 90 is titanium alloy, such as the particular alloy used for fabricating the body (e.g., Ti-6Al-4V). Desirably, the cap 90 includes a peripheral rim 94 that covers the peripheral edge 96 of the composite plate 92. The rim 94 can be continuous or discontinuous, the latter comprising multiple segments (not shown). For a cap 90 made of titanium alloy, the thickness of the titanium desirably is less than about 1 mm, and more desirably 0.07 to 0.3 mm. In one example, in which the thickness of the composite plate 92 was about 3.65 mm, a titanium cap 90 was used having a thickness of about 0.3 mm. The candidate titanium alloys for making the cap 90 are not limited to Ti-6Al-4V, and the base metal of the alloy is not limited to Ti. Other materials can be used as desired for making the cap, such as polymers, stainless steel, and other metals.

The metal cap 90 desirably is bonded to the composite face plate using a suitable adhesive 98, such as an epoxy or polyurethane adhesive. The adhesive 98 is applied so at to fill the gap completely between the cap 90 and the composite plate 92 (this gap usually in the range of about 0.05-0.2 mm, and desirably is approximately 0.1 mm). The face plate 12 desirably is bonded to the body using a suitable adhesive 100, such as an epoxy adhesive.

Surface roughness can be imparted to the composite plate 92 (notably to any surface thereof that will be adhesively bonded to the body of the club-head and/or to the metal cap 92). In a first approach, a layer of textured film is placed on the composite plate 92 before curing the film (e.g., "top" and/or "bottom" layers discussed above). An example of such a textured film is ordinary nylon fabric. Conditions under which the adhesives 98 100 are cured normally do not degrade nylon fabric, so the nylon fabric is easily used for imprinting the surface topography of the nylon fabric to the surface of the composite plate. By imparting such surface roughness, adhesion of urethane and epoxy, such as 3M® DP 460, to the surface of the composite plate so treated was greatly improved and superior to adhesion to a metallic surface, such as cast titanium alloy.

In a second approach, texture can be incorporated into the surface of a mould used for forming the composite plate 92, thereby allowing the textured area to be controlled precisely and automatically. For example, in an embodiment having a composite plate joined to a cast body, texture can be located on surfaces where shear and peel are dominant modes of failure.

A third approach involves sandblasting the scrim-weave plies 128, 130 to achieve a desired surface roughness.

Example 1

Figure 12A:
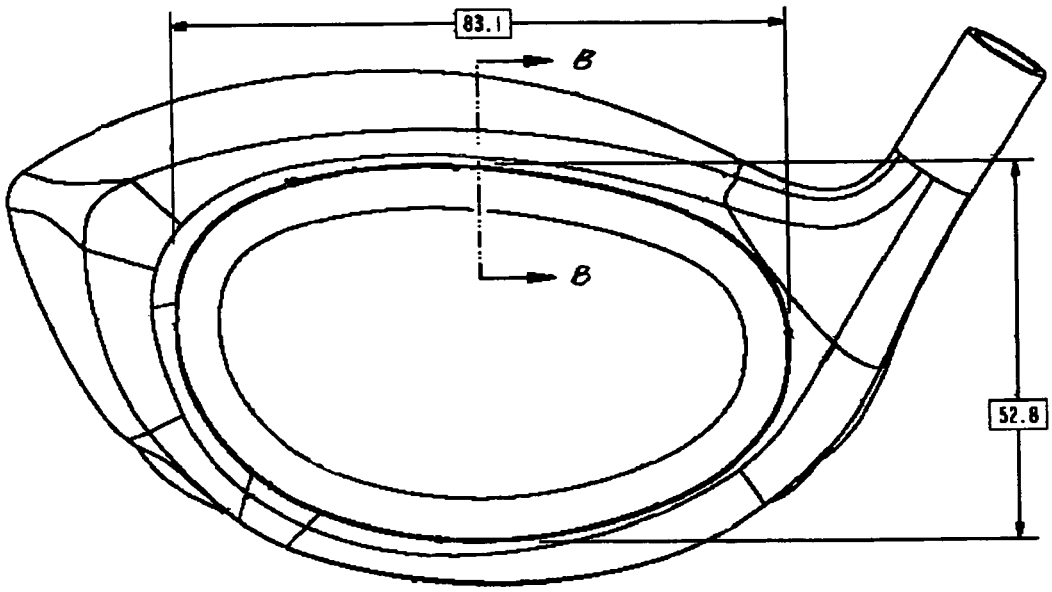
FIG. 12(A) is a front elevational view of the club-head of Examples 1 and 2.
Figure 12B:
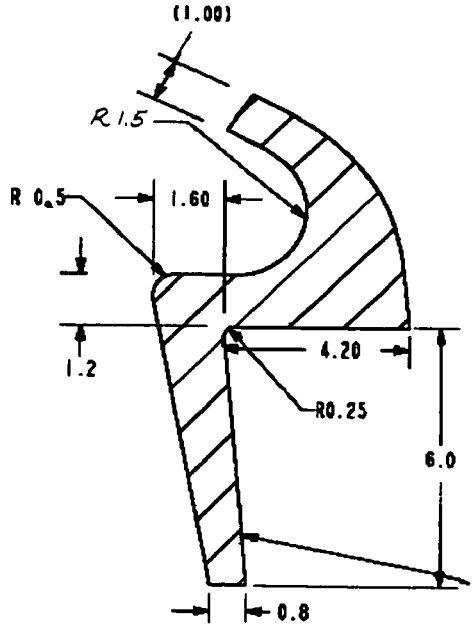
FIG. 12(B) is a partial sectional view of the upper lip region of the club-head of FIG. 12(A).

In this example, a driver club-head was fabricated having a hollow titanium body (Ti-6Al-4V) and a composite face plate having a metal cap. The body is shown in FIGS. 12(A)-12(B), wherein FIG. 12(A) is a face normal (elevational) view and FIG. 12(B) is a section through a portion of the lip. Width and height dimensions (in mm) of the opening for the face plate are shown in FIG. 12(A), and representative lip dimensions (in mm) are shown in FIG. 12(B). The radius of the lip is generally in the range of 0.1 to 3.0 mm, more desirably in the range of 0.1 to 1.0 mm.

The composite portion of the face had a mass of 26.6 g, and comprised 70 g/m$^2$ FAW carbon fiber material (34-700 carbon fiber; 34 Msi tensile modulus, 700 ksi ultimate tensile strength), and 40% R/C. Composite layup (front to back) was constant thickness: glass scrim+[Q]15+[90]+glass scrim, where Q=[90/+45/0/−45] from carbon fiber noted above, yielding a total of 61 plies.

The metal cap was made of 0.076 mm thick stainless steel (2.1 g), and bonded to the composite portion of the face plate using 0.5 g epoxy. The resulting total mass of the face plate was 29.2 g. The face plate was bonded to the body using 1.0 g epoxy. The total mass of the face (prepared as described above) was 57 g, and the face area was 5865 $mm^2$. The club-head exhibited a COR=0.820 and a CT=229 μsec, which was within regulations. The datum 150 for this club head is shown in FIG. 10.

It is noted that the same mass-to-COR/CT performance was obtained for higher FAW as well (i.e., 150 $g/mm^2$) and a lower resin content (about 34%).

Example 2

In this example, a driver club-head was fabricated having a hollow titanium body (Ti-6Al-4V) and a composite face plate having a metal cap. The body was the same as used in Example 1.

Figure 13:
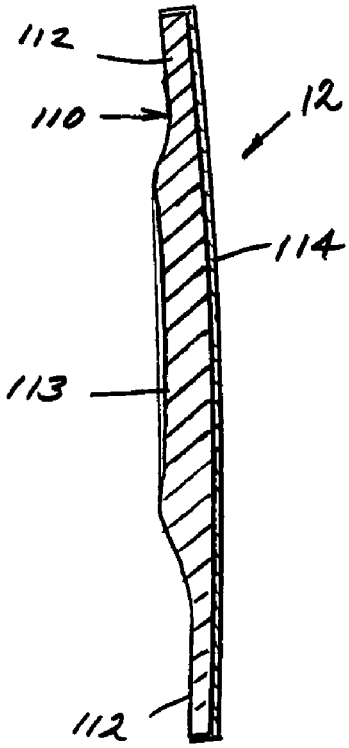
FIG. 13 is a side elevational section of an exemplary face plate comprising a composite portion and a metal cap, and having a non-uniform thickness, as evaluated in Example 2.

The composite portion of the face plate had a mass of 20.5 g, and comprised 150 $g/m^2$ FAW carbon-fiber material (34-700 carbon fiber having 34 Msi tensile modulus and 700 ksi ultimate tensile strength), and 40% final R/C. Composite layup (front to back) was variable thickness: glass scrim+[Q]+[q+Q]4+[0/90]+glass scrim, where Q=[90/+45/0/−45], full face size, from carbon fiber noted above. Referring to FIG. 13, the composite portion 110 of the face plate 12 was 22 plies thick (carbon fiber) at the edges 112, and 38 plies thick (carbon fiber) at face center 113. Where q=[90/+45/0/−45], shapes smaller than the face are positioned near "face center." The resulting "interlaminar plies" create the variable thickness of the face 12 plate shown in FIG. 13.

The metal cap 114 of the face plate 12 was made of 0.3 mm thick Ti alloy (5.6 g), and bonded to the composite portion 110 using 0.7 g epoxy. The resulting total mass of the face plate 12 was 26.8 g. To join the face plate to the body, 1.0 g epoxy was used. The total mass of the face (prepared as described above) was 54.8 g, and the face area was 5800 $mm^2$. The club-head exhibited a COR=0.824 and a CT=233 μsec, which are within regulations. The datum 152 for this club head is shown in FIG. 10.

Example 3

Figure 14A:
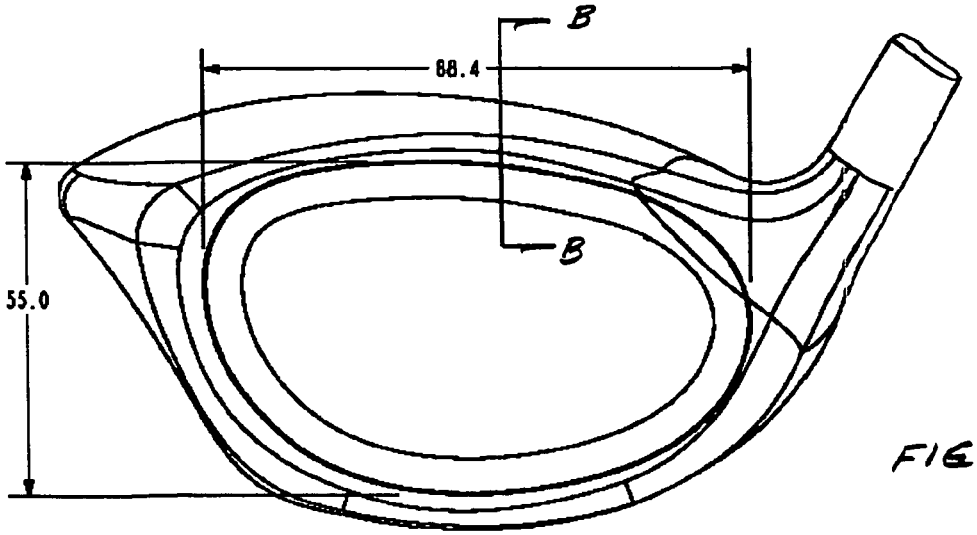
FIG. 14(A) is a front elevational view of the club-head of Example 3.
Figure 14B:
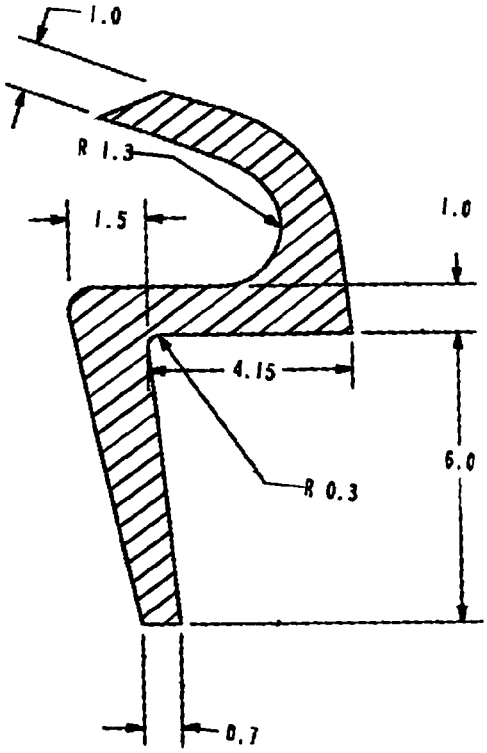
FIG. 14(B) is a partial sectional view of the upper lip region of the club-head of FIG. 14(A).

In this example, a driver club-head was fabricated having a hollow titanium body (Ti-6Al-4V) and a composite face plate having a metal cap. The body is shown in FIGS. 14(A)-14(B), wherein FIG. 14(A) is a face normal (elevational) view and FIG. 14(B) is a section through a portion of the lip. Width and height dimensions of the opening for the face plate are shown in FIG. 14(A), and representative lip dimensions are shown in FIG. 14(B).

The composite portion of the face plate had a mass of 22.6 g, and comprised 70 $g/m^2$ FAW carbon-fiber material (34-700 carbon fiber having 34 Msi tensile modulus and 700 ksi ultimate tensile strength), and 40% final R/C. Composite layup (front to back) was variable thickness: glass scrim+[Q]2+[q+Q]8+[Q]+[90]+glass scrim, where Q=[90/+45/0/−45], full face size, from carbon fiber noted above. The composite portion was 45 plies thick (carbon fiber) at face edges, and 77 plies thick (carbon fiber) at face center. Where q=[90/+45/0/−45], shapes smaller than the face are positioned near "face center." The resulting "interlaminar plies" create the variable thickness of the face plate shown in FIG. 13.

The metal cap portion of the face plate was made of 0.3 mm thick Ti alloy (6.0 g), and bonded to the composite portion using 0.6 g epoxy. The resulting total mass of the face plate was 29.2 g. To join the face plate to the body, 1.0 g epoxy was used. The total mass of the face (prepared as described above) was 55.6 g, and the face area was 6060 $mm^2$. The club-head exhibited a COR=0.815 and a CT=224 μsec, which are within regulations. The datum 154 for this club head is shown in FIG. 10.

Whereas the invention has been described in connection with representative embodiments, it will be understood that the invention is not limited to those embodiments. On the contrary, the invention is intended to encompass all modifications, alternatives, and equivalents as may be included in the spirit and scope of the invention, as defined by the appended claims.

What is claimed is:

1. A club-head for a golf club, comprising:

a hollow body defining a front opening having a face support;

a face plate affixed to the face support and covering the front opening;

a hosel; and a face portion, wherein the face portion comprises the face plate, the front opening face support, and a portion of the hollow body of the golf club head located from a tangent plane of the face plate to approximately 12 mm rearward from the tangent plane of the face plate but not including the hosel;

wherein the face portion of the club-head has a face area ($A_f$) and a face portion mass ($M_f$, in grams), $A_f \geqq 5400$ $mm^2$ and a club-head COR≦0.830, and the face mass $M_f$ is below $M_f$−0.0072($A_f$)+18; and wherein the body comprises body walls defining an external contour including a transition zone in which the external contour transitions to the face plate, and the body walls at the transition zone comprise a forward wall and a peripheral member located adjacent the front opening, each having respective interior surfaces that are joined together with a substantially constant inside radius in a range of 1.3 and 1.5 mm.

2. The club-head of claim 1, wherein the body comprises at least one wall made of metal.

3. The club-head of claim 2, wherein the metal comprises titanium alloy.

4. The club-head of claim 1, wherein at least a portion of the face plate comprises a composite material.

5. The club-head of claim 4, wherein the face plate comprises a composite plate.

6. The club-head of claim 5, wherein the composite plate comprises carbon fiber and cured epoxy resin.

7. The club-head of claim 4, wherein:

the face plate has a strike face; and the face plate comprises a composite plate and a cap bonded to the composite plate on the strike face.

8. The club-head of claim 7, wherein the cap comprises a metallic material.

9. The club-head of claim 1, wherein the face plate has a substantially uniform thickness.

10. The club-head of claim 1, wherein the face plate has a variable thickness.

11. The club-head of claim 10, wherein peripheral regions of the face plate are thinner than a central region of the face plate.

12. The club-head of claim 1, wherein:

the face plate has a strike face;

the face plate comprises a composite plate and a metal cap bonded to the composite plate on the strike face;

the composite plate has a substantially uniform thickness; and the metal cap has a substantially uniform thickness.

13. The club-head of claim 1, wherein:

the face plate has a strike face;

the face plate comprises a composite plate and a metal cap bonded to the composite plate on the strike face;

the composite plate has a variable thickness; and the metal cap has a substantially uniform thickness.

14. The club-head of claim 1, wherein:

the face plate has a strike face;

the face plate comprises a composite plate and a metal cap bonded to the composite plate on the strike face; and the body comprises body walls comprising a titanium alloy.

15. The club-head of claim 1, wherein $A_f$ is within a range of 5400 to 10,000 $mm^2$.

16. The club-head of claim 15, wherein $A_f$ is within a range of 7000 to 10,000 $mm^2$.

17. The club-head of claim 15, wherein $A_f$ is within a range of 8500 to 10,000 $mm^2$.

18. A golf club, comprising:

a club-head, comprising a hollow body and a face plate, the body defining a front opening having a face support, and the face plate being affixed to the face support and covering the front opening;

a hosel;

a shaft affixed to the hosel; and a face portion, wherein the face portion comprises the face plate, the front opening face support, and a portion of the hollow body of the golf club head located from a tangent plane of the face plate to approximately 12 mm rearward from the tangent plane of the face plate but not including the hosel;

wherein the face portion of the club-head has a face area ($A_f$) and a face portion mass ($M_f$, in grams), $A_f \geqq 5400$ $mm^2$ and a club-head COR$\leqq$0.830, and the face mass $M_f$ is below $M_f$–0.0072($A_f$)+18;

wherein the body comprises body walls defining an external contour including a transition zone in which the external contour transitions to the face plate, and the body walls at the transition zone comprising a forward wall and a peripheral member located adjacent the front opening, each having respective interior surfaces that are joined together with a substantially constant inside radius in a range of 1.3 to 1.5 mm.

19. The golf club of claim 18, further comprising a hosel to which the shaft is affixed.

20. The golf club of claim 18, configured as a driver.

21. The golf club of claim 18, wherein at least a portion of the face plate comprises a composite material.

22. The golf club of claim 21, wherein the face plate comprises a composite plate.

23. The golf club of claim 22, wherein the composite plate comprises carbon fiber and cured epoxy resin.

24. The golf club of claim 21, wherein:

the face plate has a strike face; and the face plate comprises a composite plate and a cap bonded to the composite plate on the strike face.

25. The golf club of claim 24, wherein the cap comprises a metallic material.

26. The golf club of claim 25, wherein the body comprises a titanium alloy.

27. The golf club of claim 18, wherein the face plate has a substantially uniform thickness.

28. The golf club of claim 18, wherein the face plate has a variable thickness.

29. The golf club of claim 18, wherein $A_f$ is within a range of 5400 to 10,000 $mm^2$.

30. The golf club of claim 29, wherein $A_f$ is within a range of 7000 to 10,000 $mm^2$.

31. The golf club of claim 29, wherein $A_f$ is within a range of 8500 to 10,000 $mm^2$.

* * * * *